US005709028A

United States Patent [19]

Kreutzer et al.

[11] Patent Number: 5,709,028

[45] Date of Patent: Jan. 20, 1998

[54] PROCESS OF MANUFACTURING A HEAT EXCHANGER

[75] Inventors: Josef Kreutzer, Mühlacker; Fritz Glock, Fellbach, both of Germany

[73] Assignee: BEHR GmbH & Co., Stuttgart, Germany

[21] Appl. No.: 564,573

[22] Filed: Nov. 28, 1995

[30] Foreign Application Priority Data

Dec. 24, 1994 [DE] Germany ..... 44 46 754.0

[51] Int. Cl.[6] ..... B23P 15/26

[52] U.S. Cl. ..... 29/890.047; 29/890.54; 29/523

[58] Field of Search ..... 29/890.044, 890.046, 29/890.047, 523, 890.054; 165/177, 152, 183

[56] References Cited

U.S. PATENT DOCUMENTS

| | | | |
|---|---|---|---|
| 2,883,165 | 4/1959 | Jensen et al. . | |
| 3,603,384 | 9/1971 | Huggins et al. . | |
| 3,702,632 | 11/1972 | Grimshaw | 29/890.046 |
| 4,269,267 | 5/1981 | Labranda | 29/890.046 |
| 4,327,800 | 5/1982 | Miller . | |
| 5,172,476 | 12/1992 | Joshi . | |
| 5,271,151 | 12/1993 | Wallis . | |

FOREIGN PATENT DOCUMENTS

| | | |
|---|---|---|
| 0 030 072 A2 | 6/1981 | European Pat. Off. . |
| 0306899 | 3/1989 | European Pat. Off. . |
| 1309629 | 10/1962 | France . |
| 28 39 142 | 3/1979 | Germany . |
| 3104010A1 | 12/1981 | Germany . |
| 4026988A1 | 2/1992 | Germany . |
| 2003762A | 3/1979 | United Kingdom . |

OTHER PUBLICATIONS

German Search Report, dated Jul. 6, 1995.

*Primary Examiner*—Irene Cuda

*Attorney, Agent, or Firm*—Evenson McKeown Edwards & Lenahan, PLLC

[57] ABSTRACT

Heat exchangers, which are formed by the cassetting of flat tubes and corrugated fins arranged alternately thereof, are subject to the risk of leading to a deforming of the flat tubes in the case of excessive internal pressures and thus to damage to the heat exchanger. A manufacturing process is suggested including curving the bent edges of the corrugated fins convexly toward the outside so that, during the cassetting, the lateral flanks of the flat tubes are pressed in concavely. This results in a higher bursting pressure.

6 Claims, 2 Drawing Sheets

PROCESS OF MANUFACTURING A HEAT EXCHANGER

BACKGROUND AND SUMMARY OF THE INVENTION

This invention relates to a process of manufacturing a heat exchanger, particularly a radiator for an internal-combustion engine for driving a motor vehicle of the type having flat tubes arranged in parallel to one another with fins arranged in-between in each case being pressed together to form a finned-tube block by means of forces extending transversely to the tube axes, and subsequently being soldered together.

Processes of this general type are known. The heat exchangers produced according to this process have flat tubes with flanks which extend in parallel to one another, in which case the exterior sides of these flanks are soldered together with corrugated fins which have a constant corrugation height along the whole tube length extending between the tube bottoms. In the case of such heat exchangers, damages may occur to the connection between the corrugated fins and the flat tubes when the fluid pressure in the interior of the tubes becomes so high that the flanks of the flat tubes are pressed toward the outside and may thus lead to damage to the soldered connection between the corrugated fins and the tubes. This is particularly true when a transition is to take place from the conventional vacuum soldering to new soldering processes which offer economic advantages.

In order to raise the bursting pressure to an acceptable level, turbulence inserts were therefore provided in the tubes which, however, increase the manufacturing expenditures.

In the case of heat exchangers which have flat tubes which are threaded through openings of a stack of fins (German Patent Document DE-OS 28 39 142), in order to achieve a good heat contact between the edges of the openings in the stack of fins and the tubes, the openings were provided with a shape in which the opening sides which later come in contact with the flanks of the flat tube are curved convexly toward the inside so that, during the widening of the tube which occurs by the pulling-through of an olive-shaped button or by increasing the pressure in the interior of the tube, this tube will rest particularly well against the fins in the area of the parallel flanks. However, in the case of such constructions, the finned-tube block is not formed, as in the case of the initially mentioned type, by fins arranged between the tubes.

It is also known (German Patent Document 31 04 010 A1) to bring the tubes in their end areas, by means of which they are held in the tube bottoms, into the shape of an "8" before they are pushed into the holes in the tube bottoms provided with sealing devices. By means of this measure, a particularly good sealing in the tube bottom area is to be obtained because of the elasticity of the tube walls. However, this design has nothing in common with the fastening of ribs on the side of flat tubes.

The invention is therefore based on the object of developing a process of the initially mentioned type such that, in a simple manner, the required intimate contact of the fins with the tube flanks is achieved and that mainly the bursting pressure can also be increased without requiring cumbersome measures.

For achieving this object, it is provided according to preferred embodiments of the invention in the case of a process of the initially mentioned type that the fins are in each case curved convexly in the direction of the tube axis on their edges resting against the tubes and are only then inserted between the flat tubes and pressed against the tubes so that these are laterally pressed in the area of the fins before the soldering takes place. As a result of this measure, the tubes receive in their cross-section a type of bone shape which is basically known in the case of other constructions of heat exchangers for a different purpose. However, as a result of the new manufacturing process, the flat tubes remain in their original shape in the area of their ends, thus, where they are held in the tube bottoms, so that the measures which so far have been known for connecting the tube bottoms with the tubes can be maintained but the new heat exchangers can be stressed by a higher internal pressure because the cross-sectional shape of the tubes which will then exist in the area of the fins is much more resistant to forces acting from the interior.

In a further development of the invention, in the case of a process for manufacturing a heat exchanger which has corrugated fins whose edges are formed by the bent folds of a metal strip folded in an accordion shape in at least one pair of crimpers, it is provided that the convex curvature is produced by tooth pairings in which the teeth are in each case constructed to be convex and the tooth spaces assigned thereto in the respective other roller are constructed to be concave. As a result of these measures, the desired bulging or cambering of a corrugated fin strip is achieved which will then be used during the cassetting or modular construction for the desired denting of the straight tube flanks. In this case, the convex curvature of the edges of the corrugated fins may extend so far that the tube walls are pressed so far toward the inside that they rest against one another. Care must then be taken that the remaining cross-section will be large enough for achieving the desired heat exchange performance.

In a further development of the invention, open flat tubes may at first still be provided which are formed of strips bent to a tube shape and whose one edges which form a generating line of the tube are placed loosely against one another and are connected with one another only during the soldering. Such strips which, during the cassetting operation are not yet closed to a tube shape can be deformed into the desired bone shape by relatively low forces before the final and tight tube shape is produced by soldering.

In a further development of this idea, the edges may be bent partially into the tube interior before the pressing-together takes place. The reason is that then, during the deforming taking place by the contact pressure of the corrugated fins, they may be used as an interior stop which prevents a further pressing-together of the tube walls. In this manner, the remaining free passage cross-section can be determined within the tube.

In order to finally ensure the required contact pressure onto the flanks of the tubes, it may also be provided that at the point of the largest width of the convex curvature of the corrugated fins, a reinforcing web is used which extends transversely to the corrugation of the fins and in parallel to the tube axes.

Other objects, advantages and novel features of the present invention will become apparent from the following detailed description of the invention when considered in conjunction with the accompanying drawings.

DETAILED DESCRIPTION OF THE DRAWINGS

Figure 1:
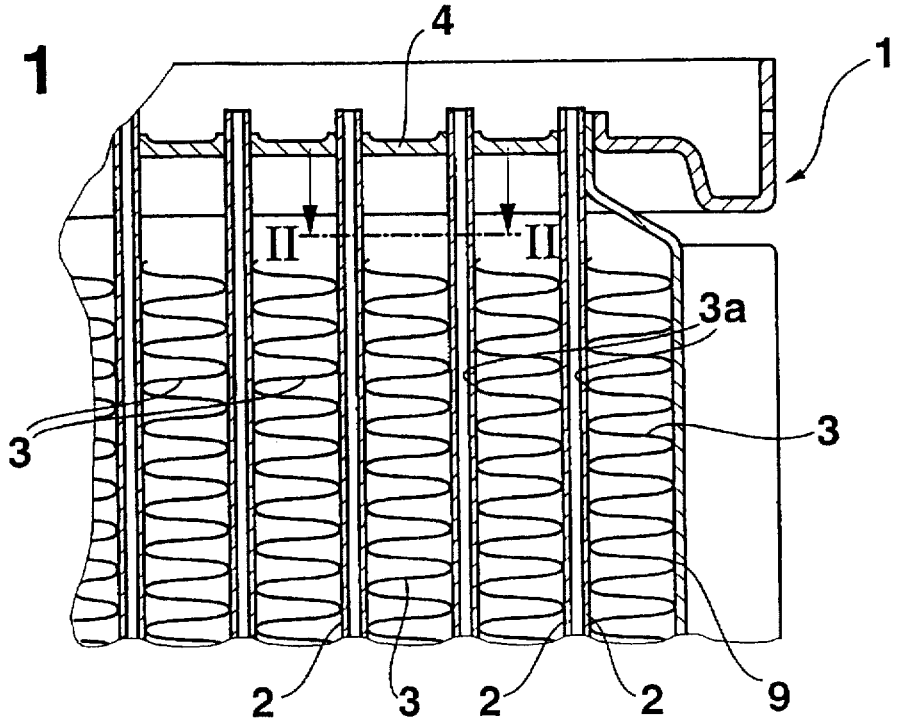
FIG. 1 is a schematic partial sectional view of the right upper end of a finned tube block constructed according to the invention before the coolant box is placed on it.

FIG. 1 illustrates a section of a heat exchanger 1 which is used as a radiator for a motor vehicle engine. In this case, FIG. 1 shows the heat exchanger still in the condition without a fitted-on coolant box.

The heat exchanger 1 consists of several flat tubes 2 which are arranged in parallel to one another and between which respective corrugated fins 3 are arranged in such a manner that the edges 3*a* formed by the foldings rest tightly against the lateral flanks of the flat tubes 2 and are soldered to them. On their upper and lower ends (the lower ends are not shown), the flat tubes 2 are pushed into tube bottoms 4 and are held tightly in corresponding openings of the tube bottom 4. In a known manner, during the operation—when the tube bottoms are provided with corresponding coolant boxes—, the coolant flows through the tubes 2 to another coolant box while the air used for cooling this fluid flowing through the engine flows perpendicularly to the plane of the drawing between the corrugated fins 3 and along the flanks of the flat tubes 2.

Figure 2:
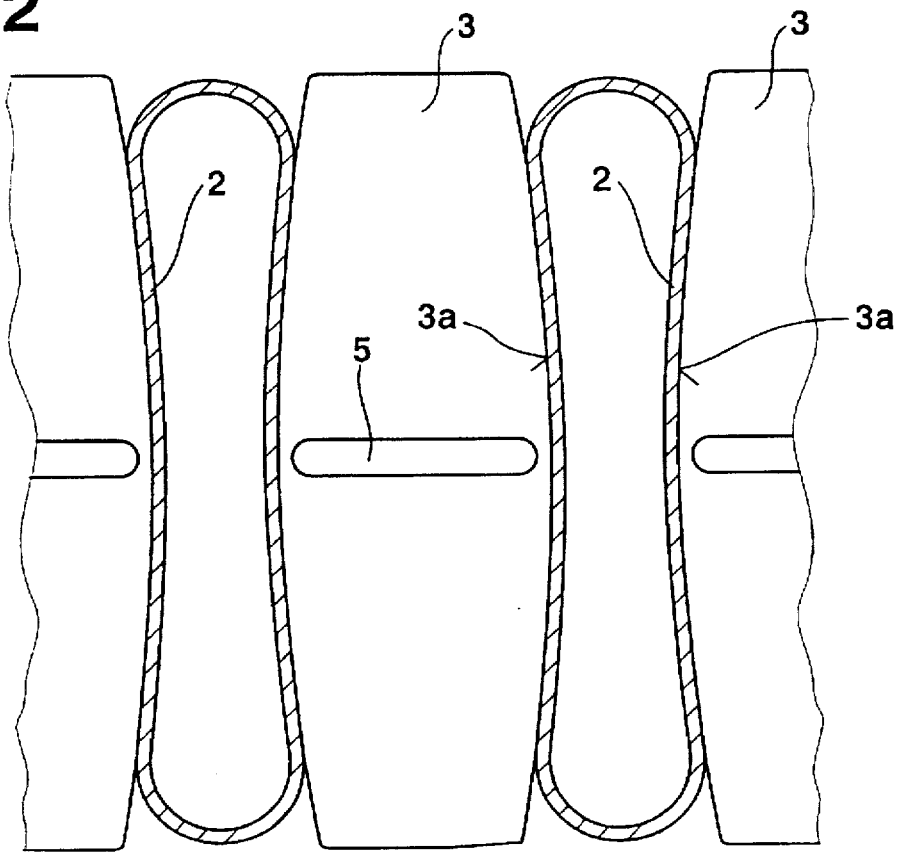
FIG. 2 is an enlarged representation of the partial sectional view according to the intersecting line II—II of the heat exchanger of FIG. 1.

As shown in FIG. 2, the edges 3*a* of the corrugated fins 3 are curved convexly toward the outside so that, as a result, when the heat exchanger 1 is manufactured, which will still be described, the lateral flanks of the flat tubes 2 indent concavely toward the inside and the flat tubes 2 receive a type of bone shape in the installed condition. FIG. 2 also shows that the corrugated fins 3 may each be provided with reinforcing webs 5 extending transversely to their edges 3*a*, which reinforcing webs 5 are fitted longitudinally through corresponding openings of the corrugated fins. These reinforcing webs 5 extend in the center of the corrugated fins 3, that is, in the area in which these corrugated fins have the largest bulging on their edges and the largest width. As illustrated in FIG. 2, this largest width is also situated in the transverse center plane of the flat tubes 2.

Figure 3:
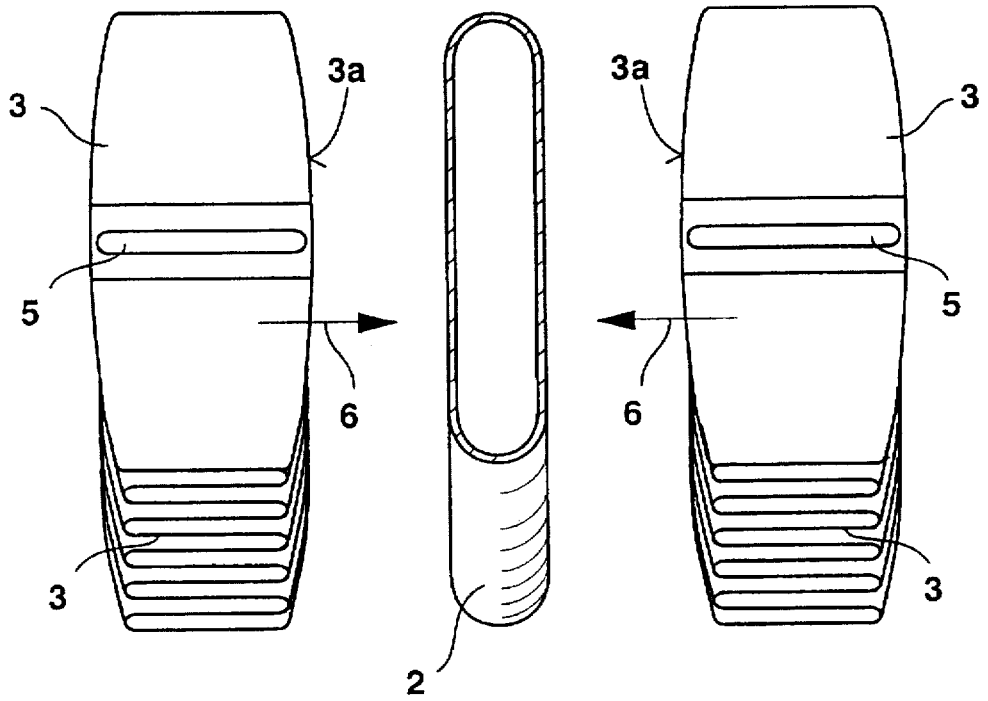
FIG. 3 is a schematic representation of the manufacturing operation for the tube shapes of FIG. 2.

FIG. 3 schematically explains the type of the manufacturing of the new heat exchanger in a slightly perspective view from above of the parts to be assembled, in which case only a flat tube 2 and the two corrugated ribs 3 adjoining this flat tube are shown. Naturally, the two shown corrugated fins 3 are in turn adjoined on the outside by other flat tubes which, in turn, are bordered by corrugated fins.

During the manufacturing of the heat exchanger 1 measures are first taken that the corrugated fins 3, which are normally produced as early as by the deforming of a metal strip in the crimper pairs, are provided with the above-described convexly bulging edges 3*a*. This may be carried out by the fact that the teeth of the tooth pairings are in each case constructed to be convex and the tooth gaps assigned thereto are constructed concavely in the respective other roller so that, after a passing through the crimper pairs, the cambered construction of the corrugated fins 3 is obtained which is shown in FIGS. 2 and 3. The corrugated fins 3 are then brought to a length which corresponds to the length of the flat tubes 2 and are provided with the reinforcing webs 5. Then, together with the flat tubes, they are subjected to a so-called cassetting operation in which the flat tubes 2 and the corrugated ribs 3 alternately resting against one another are joined and are then pressed against one another by lateral forces in the direction of the arrows 6. By means of the convex curvature of the edges 3*a* of the corrugated fins 3, during this pressing-together, the bone shape of the flat tubes 2 is obtained which is shown in FIG. 2; that is, that the lateral flanks, which because of their size are relatively flexible, are pressed convexly toward the inside. When this operation is concluded, the soldering-together will take place and the end shape of the heat exchanger 1 is obtained which is shown in FIGS. 1 and 2, in which the flat tubes have no lateral flanks which extend in parallel to one another. It was found that this tube shape is particularly resistant with respect to pressures in the interior of the tubes, that is, inside the coolant system, and the bursting pressure of such a heat exchanger may be significantly higher than in the case of heat exchangers with flat tubes whose lateral flanks extend in parallel to one another.

As illustrated by the above, the area of the indented lateral flanks of the flat tubes 2 is limited to the area of the corrugated fins. In their end areas, the flat tubes remain undeformed and can therefore be tightly connected with the tube bottoms 4 in a known manner.

Figure 4:
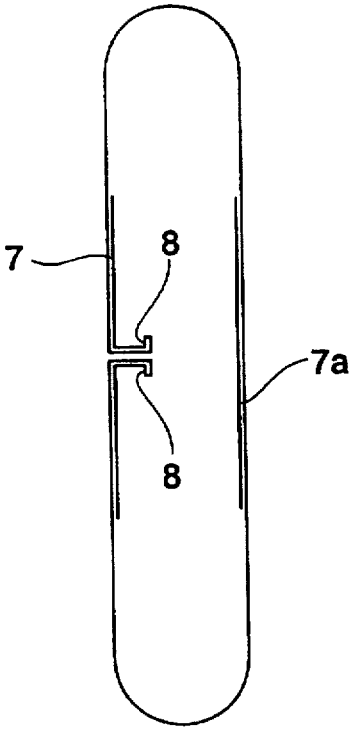
FIG. 4 is a view of a variant of a flat tube for implementing the process according to the invention before the assembly into a heat exchanger.
Figure 5:
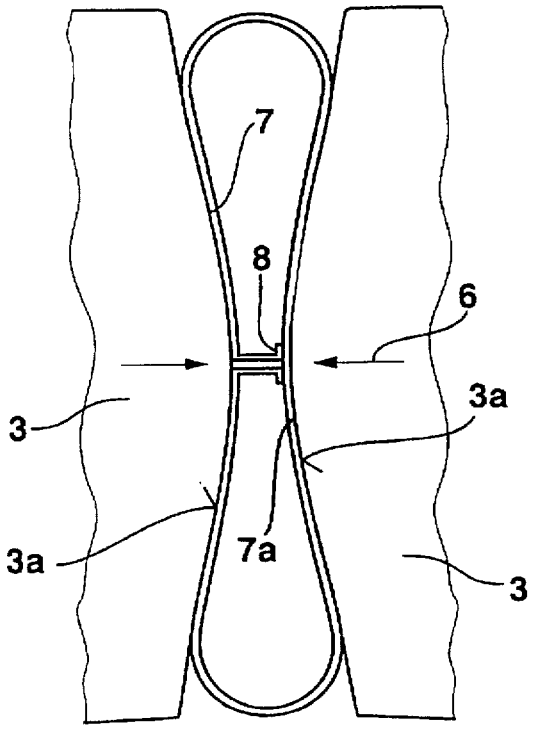
FIG. 5 is a view of the flat tube of FIG. 4 in the installed condition after or during the cassetting.

FIGS. 4 and 5 show a modification of a flat tube 7 which can be used for the manufacturing of the new heat exchanger. According to FIG. 4, this flat tube 7 is first bent from a metal strip whose ends have edges 8 which are bent into the interior of the later formed tube 7 and, in the condition of FIG. 4, still rest loosely against one another.

According to FIG. 5, the thus produced but not yet closed flat tubes 7 are subjected to a cassetting operation and are convexly curved toward the inside on their flanks by the then exercised compressing forces 6. As illustrated in FIG. 5, this may take place to such an extent that the inwardly bent edges 8 come to rest on the opposite flank 7*a* and are used as a supporting web against a further compression. In the position according to FIG. 5, the soldering-together and — naturally — the lateral framing of tubes 2 and corrugated fins 3 will then take place by means of the lateral parts 9 illustrated in FIG. 1.

The embodiment of FIG. 4 and 5 ensures in this case that, as a result of the cassetting operation, always the same compression of the tubes 7 to a predetermined bone shape will take place without having to maintain given forces during the compression. Since, in the case of the embodiment of FIGS. 4 and 5, there is a center web inside the clear width of the flat tubes 7 in the form of the soldered-on edges 8, this embodiment is particularly suitable for high internal pressures of the coolant system.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Process of manufacturing a heat exchanger, particularly a radiator for an internal-combustion engine for driving a motor vehicle, comprising:

arranging flat tubes in parallel to one another with fins arranged in-between and pressed together to form a finned-tube block by means of forces extending transversely to the tube axes, and subsequently soldering the flat tubes and fins together, wherein the fins are convexly curved in direction of an adjacent tube in each case on fin edges resting against the adjacent tubes and are only then inserted between the flat tubes and pressed against the flat tubes so that the tubes are laterally pressed to form a concave shape by respective convexly curved edges of the fins before the soldering-together takes place.

2. Process according to claim 1, wherein the fins are corrugated fins whose edges are formed by the bent folds of a metal strip folded in an accordion shape in at least one crimper pair, and wherein the convex curvature is produced by tooth pairings in the case of which the teeth are in each case constructed to be convex and the tooth gaps assigned thereto in the respective other roller are constructed to be concave.

3. Process according to claim 1, wherein said tubes are still open before the soldering-together and are formed of strips bent into a tube shape whose edges forming a generating line are loosely placed against one another and are connected with one another only during the soldering-together.

4. Process according to claim 3, wherein the edges are bent partially into the tube interior before the compressing takes place.

5. Process according to claim 4, wherein the edges are bent so far into the tube interior that, after the compressing, they rest against the closed side of the tube before the soldering-together takes place.

6. Process according to claim 1, wherein a reinforcing web is inserted at the point of the largest width of the convex curvature, which reinforcing web extends transversely to the corrugation of the ribs and in parallel to the tube axes.

* * * * *